US011578866B2

(12) United States Patent
Akagi

(10) Patent No.: US 11,578,866 B2
(45) Date of Patent: Feb. 14, 2023

(54) TOTALLY AERATED COMBUSTION BURNER

(71) Applicant: RINNAI CORPORATION, Aichi (JP)

(72) Inventor: Kazuyuki Akagi, Aichi (JP)

(73) Assignee: RINNAI CORPORATION, Aichi (JP)

( * ) Notice: Subject to any disclaimer, the term of this patent is extended or adjusted under 35 U.S.C. 154(b) by 32 days.

(21) Appl. No.: 17/233,779

(22) Filed: Apr. 19, 2021

(65) Prior Publication Data

US 2021/0348756 A1 Nov. 11, 2021

(30) Foreign Application Priority Data

May 8, 2020 (JP) ..... JP2020-082363

(51) Int. Cl.
*F23D 14/14* (2006.01)
*F23D 14/74* (2006.01)
*F23D 14/62* (2006.01)

(52) U.S. Cl.
CPC ..... *F23D 14/145* (2013.01); *F23D 14/14* (2013.01); *F23D 14/62* (2013.01); *F23D 14/74* (2013.01); *F23D 2203/10* (2013.01); *F23D 2203/102* (2013.01); *F23D 2203/103* (2013.01); *F23D 2203/106* (2013.01); *F23D 2209/20* (2013.01); *F23D 2900/14001* (2013.01)

(58) Field of Classification Search
CPC ..... F23D 14/14; F23D 14/145; F23D 14/62; F23D 14/74; F23D 2203/10; F23D 2203/102; F23D 2203/103; F23D 2203/106; F23D 2209/20; F23D 2900/14001
USPC ..... 431/350
See application file for complete search history.

(56) References Cited

U.S. PATENT DOCUMENTS 3,084,736 A * 4/1963 Mentel ..... F23D 14/145 431/329
5,520,536 A * 5/1996 Rodgers ..... F23D 14/02 431/170
10,151,478 B2 * 12/2018 Park ..... F23D 14/145
10,612,776 B2 4/2020 Ono et al.

FOREIGN PATENT DOCUMENTS

JP 11-182815 A 7/1999
JP 2017-116160 A 6/2017

* cited by examiner

*Primary Examiner* — Steven B McAllister
*Assistant Examiner* — Benjamin W Johnson
(74) *Attorney, Agent, or Firm* — Cermak Nakajima & McGowan LLP; Tomoko Nakajima

(57) ABSTRACT

An outer peripheral edge part of the air-fuel mixture permeable member is connected to a portion away outward by a predetermined distance from an inner peripheral edge of the burner frame. Between the burner frame and the air-fuel mixture permeable member a clearance reaching the inner peripheral edge of the burner frame is secured at a position inward of the outer peripheral part of the air-fuel mixture permeable member. Preferably, a bent edge part formed on an inner peripheral edge of the burner frame, in a manner to be bent toward the air-fuel mixture permeable member. The amount of the air-fuel mixture to flow into the clearance is limited to a smaller amount.

5 Claims, 7 Drawing Sheets

TOTALLY AERATED COMBUSTION BURNER

This application claims priority under 35 U.S.C. § 119 to Japanese Patent Application No. 2020-082363, filed May 8, 2020, which is incorporated by reference.

TECHNICAL FIELD

The present invention relates to a totally aerated combustion burner provided with a burner body which is supplied inside thereof with an air-fuel mixture, and a combustion plate part which covers an open surface of the burner body and through which the air-fuel mixture is ejected.

BACKGROUND ART

As this kind of totally aerated combustion burner, an arrangement is known in which the combustion plate part is made up of: a burner frame in the shape of a picture frame; a member permeable to an air-fuel mixture (hereinafter called "an air-fuel mixture permeable member"), the air-fuel mixture permeable member being made of heat-resistant fibers in order to cover, from a burner body side, an opening enclosed by the burner frame; and a distribution plate overlapped (stacked) on that back surface of the air-fuel mixture permeable member which faces the burner body side, the distribution plate having formed therein a multitude of distribution holes (see, e.g., patent document 1). According to this known example, an outer peripheral edge part of the distribution plate is spot-welded to the burner frame in a state in which an outer peripheral edge part of the air-fuel mixture permeable member is pinched between the burner frame and the distribution plate.

Further, as another known example, there is known one in which the combustion plate part is constituted by: a burner frame in the shape of a picture frame; and an air-fuel mixture permeable member made of heat-resistant fibers which cover, from a side opposite to the burner body, an opening enclosed by the burner frame (see, e.g., patent document 2).

In the above-mentioned former known example, since the air-fuel mixture permeable member is compressed between the distribution plate and the burner frame, that portion of the air-fuel mixture permeable member which coincides with the peripheral region of the opening near the burner frame becomes a state of being compressed to a certain degree. Through this portion a small amount of air-fuel mixture will seep into the peripheral region of the opening. Then, in the peripheral region of the opening the seeped air-fuel mixture of low ejection velocity will form a flame that is hard to be lifted. Due to flame holding (or flame stabilizing) function by this flame, the resistant property to flame lifting can be improved.

On the other hand, in the above-mentioned latter known example, the air-fuel mixture that flows into the peripheral region of the opening permeates through the air-fuel mixture permeable member, and is ejected at the same velocity as in the other portions. Therefore, the flame that is hard to be lifted will no longer be formed around the peripheral region of the opening, thereby deteriorating the resistant property to flame lifting.

PRIOR ART DOCUMENTS

Patent Documents

Patent Document 1: JP2017-116160A
Patent Document 2: JP1999-182815A

SUMMARY

Problems that the Invention is to Solve

In view of the above points, this invention has a problem in providing a totally aerated combustion burner provided with: a burner frame in the shape of a picture frame; and an air-fuel mixture permeable member made of heat-resistant metal fibers which cover, from the burner body side, an opening enclosed by the burner frame, so that the resistant property to flame lifting property can be improved.

Means for Solving the Problems

In order to solve the above-mentioned problem, this invention is a totally aerated combustion burner comprising: a burner body which is supplied inside thereof with an air-fuel mixture; and a combustion plate part which covers an open surface of the burner body and through which the air-fuel mixture is ejected. The combustion plate part is made up of a burner frame in a shape of a picture frame, and an air-fuel mixture permeable member which is made of heat-resistant fibers and which covers, from a side opposite to the burner body, an opening enclosed by the burner frame. An outer peripheral edge part of the air-fuel mixture permeable member is connected to a portion away outward by a predetermined distance from an inner peripheral edge of the burner frame. A stepped part is formed in at least one of the burner frame and the air-fuel mixture permeable member at a position inward of the outer peripheral edge part of the air-fuel mixture permeable member, the stepped part being bent in a direction away from the other of the burner frame and the air-fuel mixture permeable member. And a clearance reaching the inner peripheral edge of the burner frame is secured by the stepped part, between the burner frame and the air-fuel mixture permeable member.

According to this invention, the air-fuel mixture that flows from the periphery of the opening enclosed by the burner frame into the clearance between the burner frame and the air-fuel mixture permeable member penetrates (passes through) that portion of the air-fuel mixture permeable member which faces this clearance. Therefore, by restricting the amount of the air-fuel mixture flowing into the above-mentioned clearance to a smaller amount, the ejection velocity of the air-fuel mixture from that portion of the air-fuel mixture permeable member which faces this clearance can be made smaller. Therefore, a flame hard to get lifted can be formed in that portion of the air-fuel mixture permeable member which faces the above-mentioned clearance, i.e., in such a portion adjacent to the outward in the periphery of the opening enclosed by the burner frame. Resistant property to flame lifting can be improved.

By the way, in order to secure the clearance between the burner frame and the air-fuel mixture permeable member even under the occurrence of thermal deformations and the like, the clearance must be made larger to a certain degree. Then, it becomes difficult to restrict the amount of air-fuel mixture flowing into the clearance to a smaller amount. In this case, by forming a bent edge part on the inner peripheral edge of the burner frame, in a manner to be bent toward the air-fuel mixture permeable member, the amount of air-fuel mixture flowing into the clearance can be restricted to a smaller amount.

However, only by forming the above-mentioned bent edge part, the bent edge part and the air-fuel mixture permeable member will come too close to each other due to thermal deformation and the like, whereby the amount of the air-fuel mixture to flow through the above-mentioned clearance will become too little. In this case, preferably that portion of the burner frame which faces the clearance shall be formed therein a plurality of through-holes at a distance from one another in a circumferential direction. Or else, by forming in the bent edge part a plurality of notches at a distance from one another in a circumferential direction, the air-fuel mixture can flow into the above-mentioned clearance via the through-holes or the notches. Therefore, the air-fuel mixture flowing into the above-mentioned clearance can be prevented from getting too small in amount.

By the way, in this invention, a distribution plate having therein a multiplicity of distribution holes shall preferably overlap that rear surface of the air-fuel mixture permeable member which faces the burner frame side.

PREFERRED EMBODIMENTS FOR CARRYING OUT THE INVENTION

Figure 1:
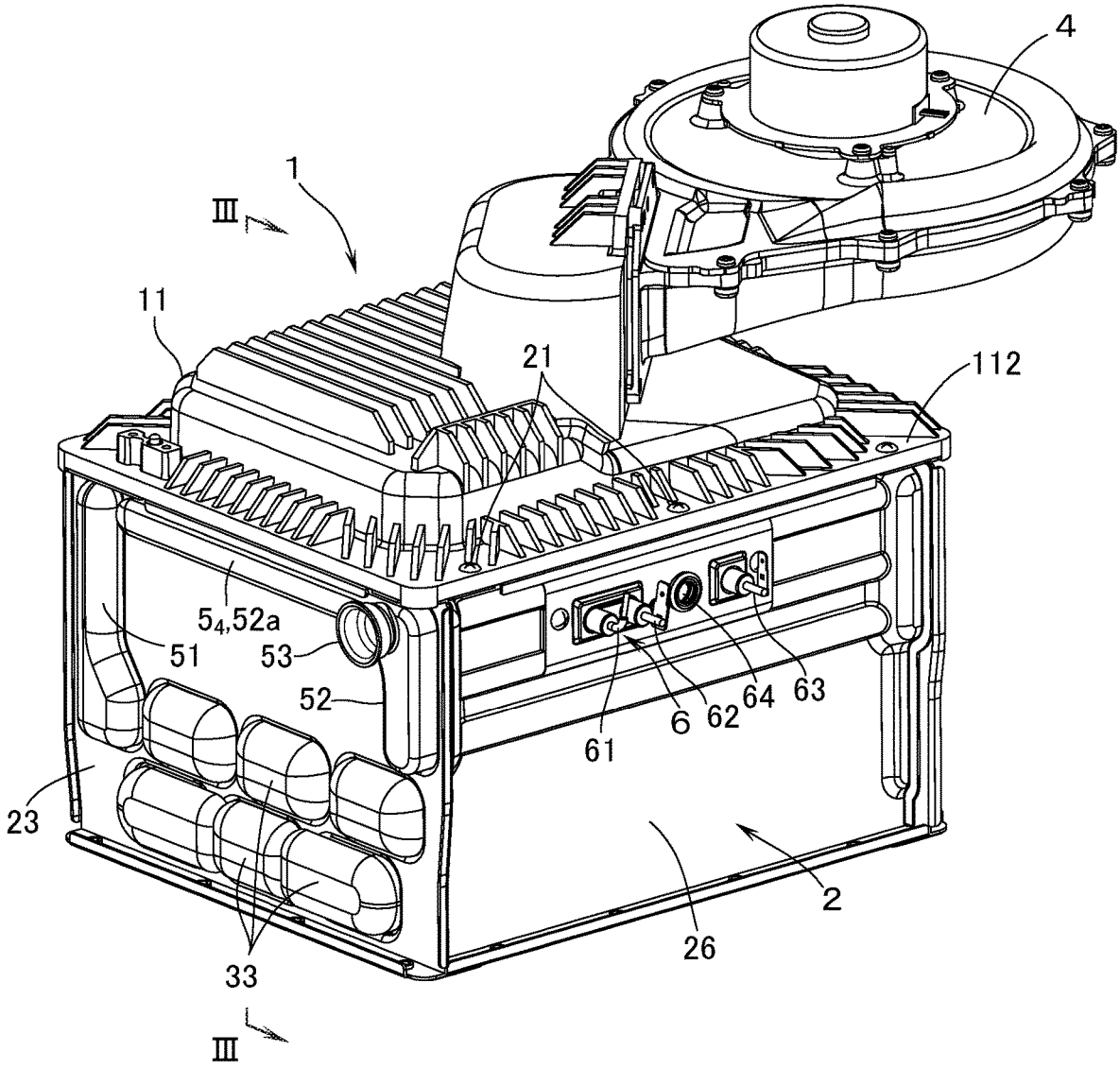
FIG. 1 is a perspective view of a combustion apparatus equipped with a totally aerated combustion burner according to a first embodiment of this invention.

A combustion apparatus shown in FIGS. 1 through 4 is provided with: a totally aerated combustion burner 1 according to an embodiment of this invention, the burner 1 having a burner body 11 which is supplied inside thereof with air-fuel mixture (mixture gas of fuel gas and primary air), and a combustion plate part 12 which covers a downward open surface 111 of the burner body 11; and a combustion box 2 having a box flange part 22 at an upper end thereof, the box flange part 22 being fastened with screws 21 to a body flange part 112 enclosing an open surface 111 of the burner body 11. The combustion box 2 has housed therein a heat exchanger 3 for hot water supply.

The heat exchanger 3 is constituted by a fin-tube type of heat exchanger provided with a multiplicity of fins 31 and a plurality of heat-absorbing tubes 32 which penetrate these fins 31. On an outside surface of side plate 23, 24 on laterally one side and the opposite side, respectively, of the combustion box 2, there are provided a plurality of connection covers 33 which define connection passages of the adjacent two heat absorbing tubes 32, 32 between each of the side plates 23, 24. In this manner, all the heat-absorbing tubes 32 are connected together in series with one another. Further, the connection cover 33 defining the connection passage, which is connected to the heat absorbing tube 32 on an upstream end of the heat exchanger 3, between the side plates 24 of the laterally opposite side is provided with a water inlet 34.

Furthermore, on an inside of that portion of a rear-side side plate 25 of the combustion box 2 which is above the heat exchanger 3, there are disposed vertically arranged three pieces of first water passages $\mathbf{5}_1$ made up of tubes in a manner to contact the side plate 25. Also on an inside of that portion of a front-side side plate 26 of the combustion box 2 which is above the heat exchanger 3, there are also disposed vertically arranged three pieces of third water passages $\mathbf{5}_3$ made up of tubes in a manner to contact the side plate 26. In addition, on an outside surface of the laterally one-side side plate 23 of the combustion box 2, there are connected: an inlet-side header cover 51 defining, together with the side plate 23, a connection passage which connects the vertically disposed three pieces of first water passages $\mathbf{5}_1$ to the heat absorbing tube 32 on a downstream end of the heat exchanger 3; and an outlet side header cover 52 defining, together with the side plate 23, a connection passage for the vertically arranged three pieces of third water passages $\mathbf{5}_3$. The outlet side header cover 52 is provided with a hot water outlet 53.

Figure 2:
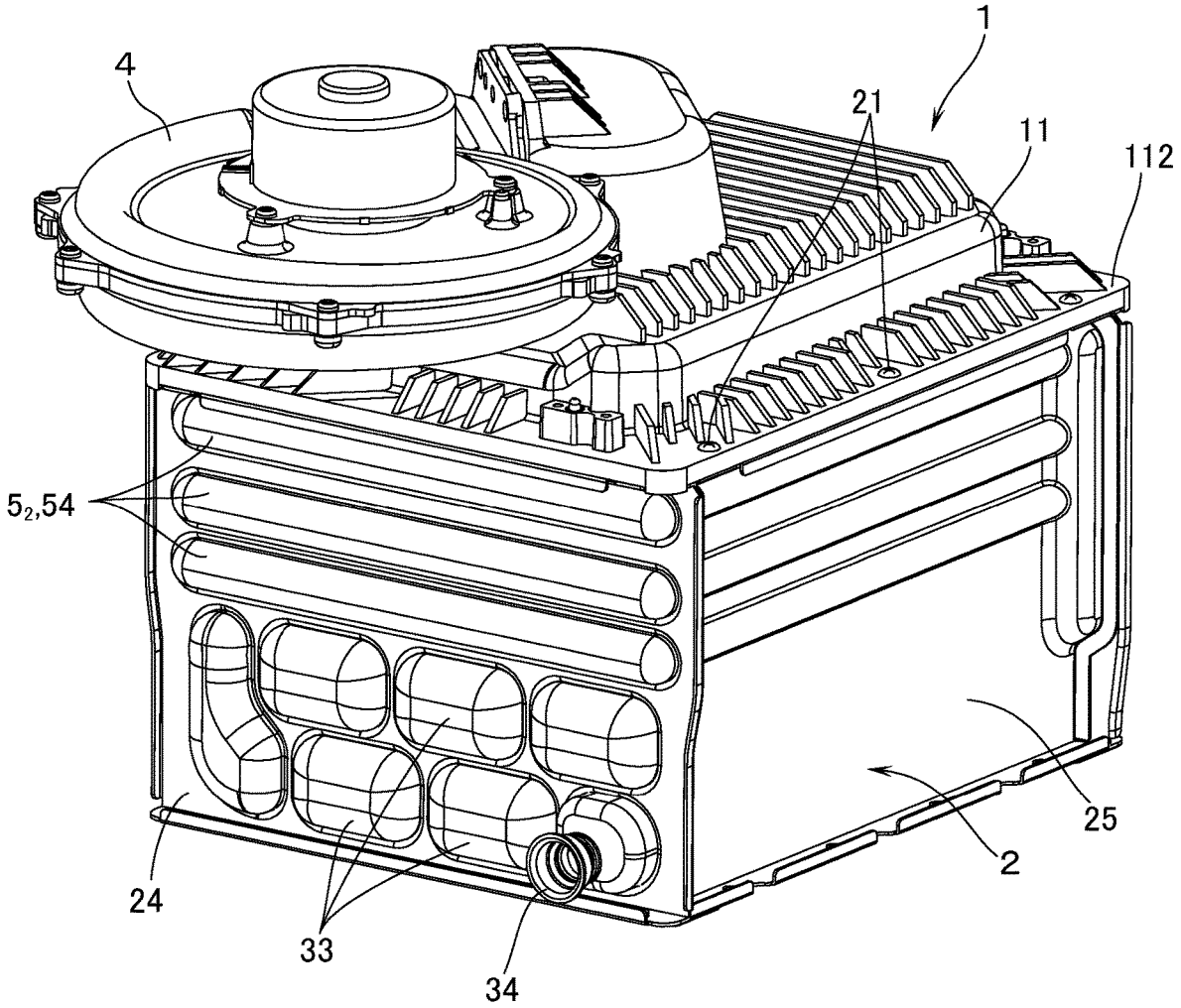
FIG. 2 is a perspective view of the combustion apparatus as viewed from a side opposite to that in FIG. 1.
Figure 3:
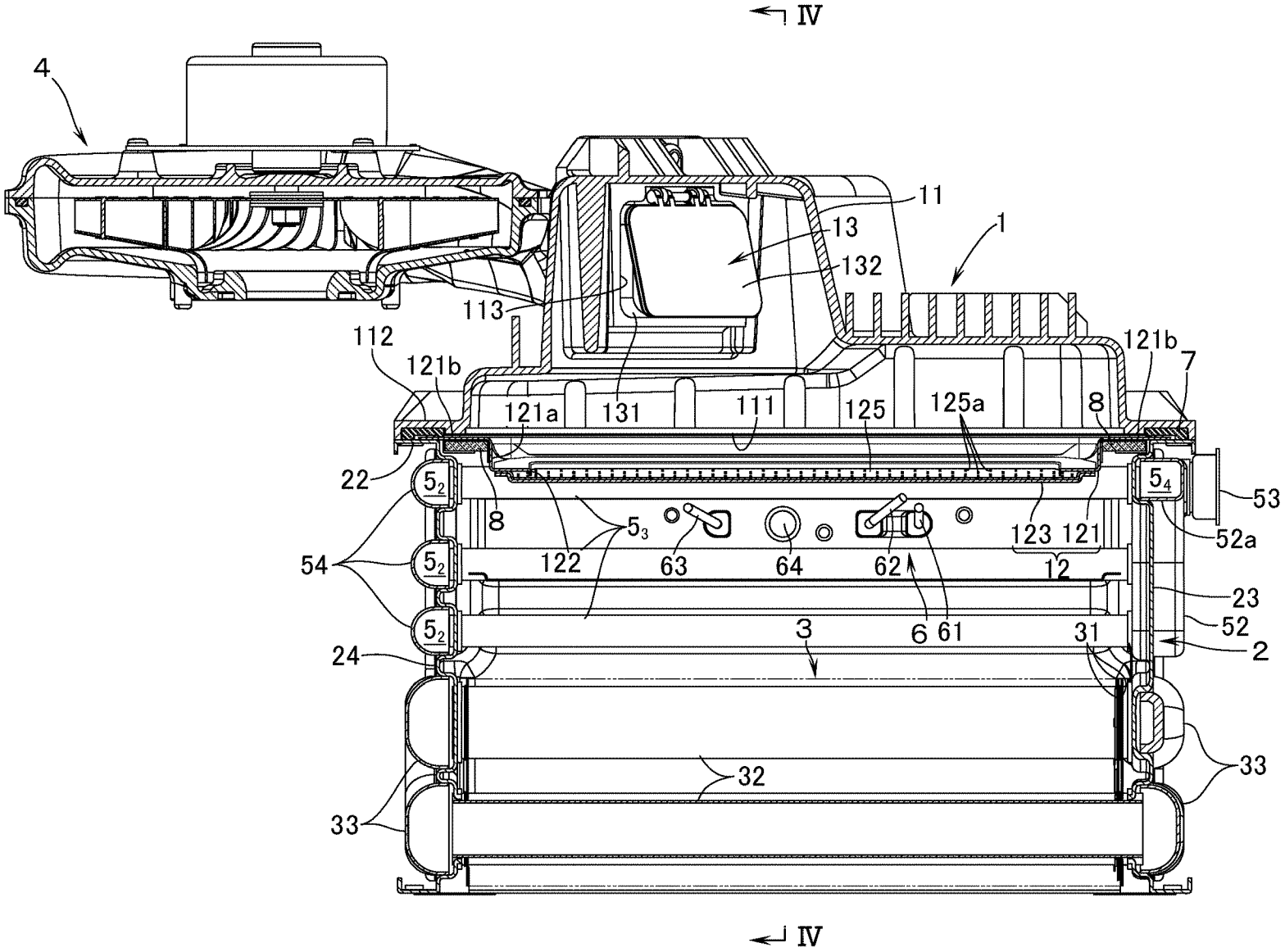
FIG. 3 is a sectional view cut away along the line III-III in FIG. 1.
Figure 4:
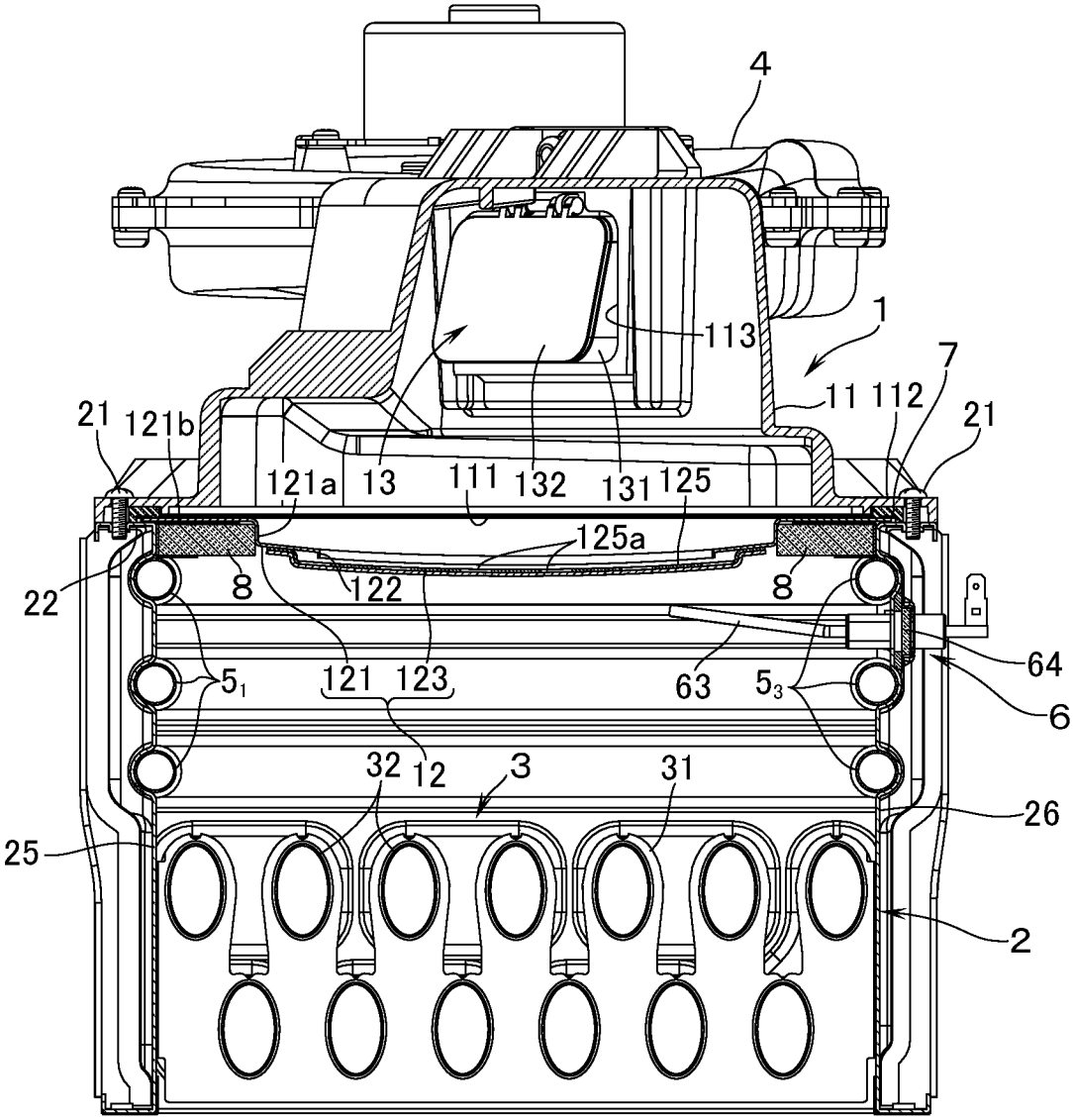
FIG. 4 is a sectional view cut away along the line IV-IV in FIG. 3.

Furthermore, as shown in FIGS. 2 and 3, the laterally opposite-side side plate 24 of the combustion box 2 is provided with second water passages $\mathbf{5}_2$ which connect the rear side first water passages $\mathbf{5}_1$ and the front side third water passages $\mathbf{5}_3$. Each of the second water passages $\mathbf{5}_2$ is made up of: a laterally inward dent which is formed in the side plate 24; and a cover 54 which is mounted on an outside surface of the side plate 24 in a manner to cover the dent. It is thus so arranged: that the water to be supplied from the water inlet 34 is heated by the heat exchanger 3; and that the heated water flows out of the hot water outlet 53 through the connection passage inside the inlet-side header cover 51, the first water passages $\mathbf{5}_1$, the second water passages $\mathbf{5}_2$, the third water passages $\mathbf{5}_3$, and the connection passage inside the outlet-side header cover 52. In addition, the laterally one-side side plate 23 of the combustion box 2 is provided with a fourth water passage $\mathbf{5}_4$ which extends rearward, from an upper portion, of the connection passage inside the outlet-side header cover 52, the fourth water passage $\mathbf{5}_4$ being constituted by: a laterally inward dent which is formed in the side plate 23; and a cover 52*a* which covers this dent and which is integral with the outlet-side header cover 52. It is thus so arranged that each of the side plates 23-26 of the combustion box 2 is cooled by the water which flows through these first through fourth water passages $\mathbf{5}_1$-$\mathbf{5}_4$.

Further, the front-side side plate 26 of the combustion box 2 has mounted thereon electrode parts 6 having an ignition electrode 61, a grounding electrode 62, and a flame rod 63 which are protruded through the side plate portion between the two, i.e., the first and the second from the top, of the third water passages 53, 53 into the combustion box 2. The electrode parts 6 are additionally provided with an inspection window 64 through which the inside of the combustion box 2 can be visually inspected.

Detailed description will now be made of the totally aerated combustion burner 1. The burner body 11 has opened therethrough an inlet port 113 for connecting thereto a fan 4 which supplies air-fuel mixture. The inlet port 113 has mounted thereon a check valve 13 which prevents the air-fuel mixture remaining inside the burner body 11 from flowing backward to the side of the fan 4, at the time of stopping of the fan 4. The check valve 13 is made up of: a resin-made valve box 131 which is built into the inlet port 113; and a resin-made valve plate 132 which is rotatably mounted, so as to be opened or closed, in that opening of the valve box 131 which faces inward of the burner body 11.

Figure 5:
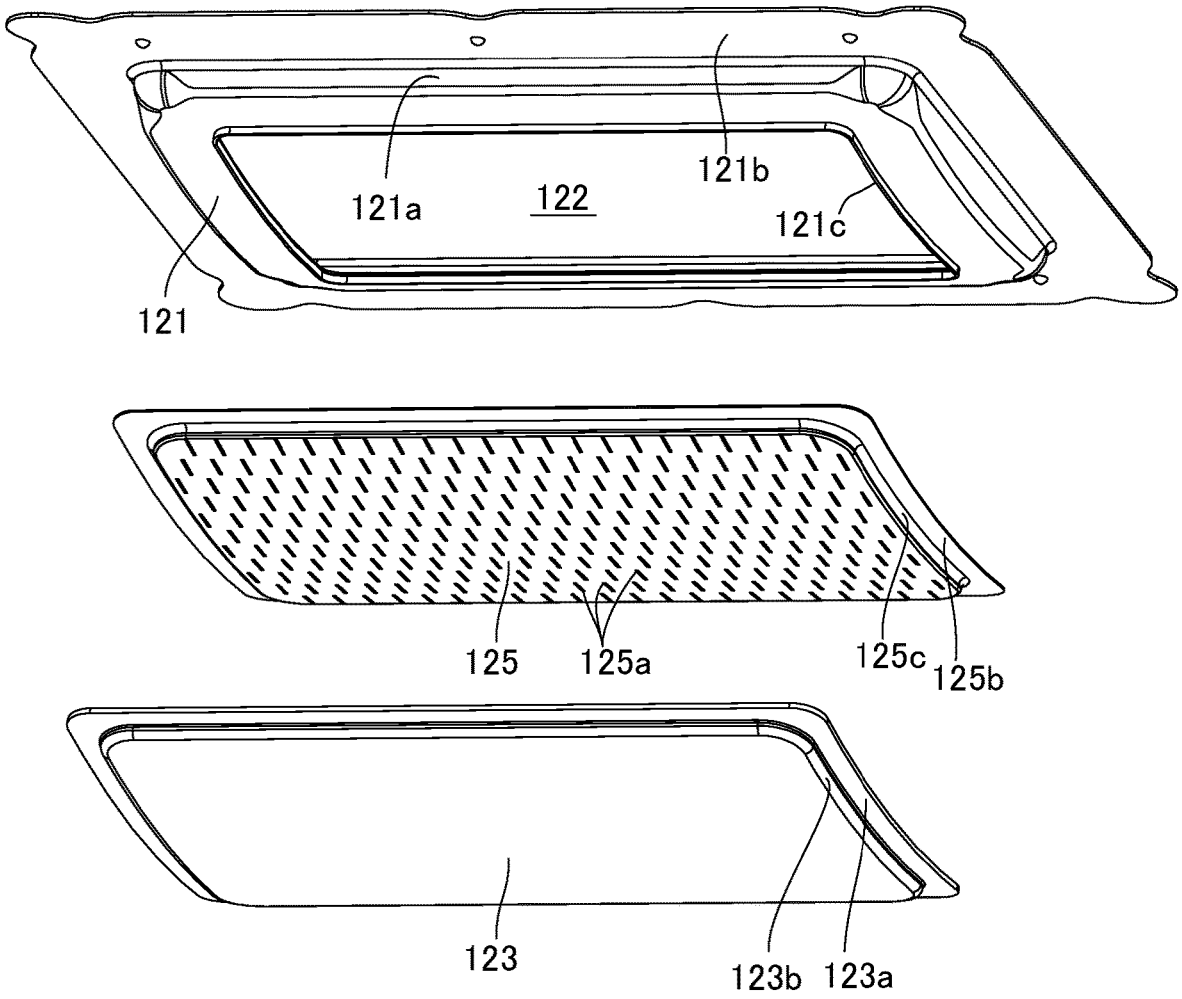
FIG. 5 is a perspective view in an exploded state of the totally aerated combustion burner according to the first embodiment.
Figure 6:
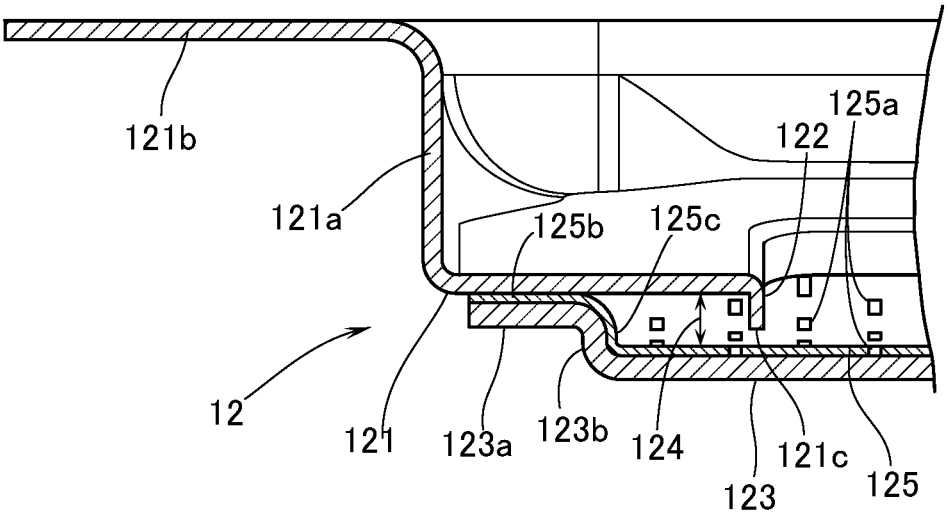
FIG. 6 is an enlarged sectional view of an essential part in an assembled state of the combustion plate part in FIG. 5.

With reference also to FIGS. 5 and 6, the combustion plate part 12 is made up of: a burner frame 121 in the shape of a picture frame; and an air-fuel mixture permeable member 123 which is made of heat-resistant fibers and which covers, from a side opposite to the burner body 11 (lower side). The air-fuel mixture permeable member 123 is constituted by a knit fabric or felted non-woven fabric of metal or nonmetal heat-resistant fibers such as SiC and the like. Then, an outer peripheral edge part 123*a* of the air-fuel mixture permeable member 123 is connected by spot welding to a portion away outward by a predetermined distance from an inner peripheral edge of the burner frame 121. The air-fuel mixture supplied into the burner body 11 passes through the opening 122 and then penetrates the air-fuel mixture permeable member 123 for further ejection, thereby performing totally aerated combustion.

In the outer peripheral part of the burner frame 121 there are formed: a side plate part 121*a* which is bent toward the burner body 11 side (upward); and a frame flange part 121*b* which sticks out (protrudes) from an upper end of the side plate part 121*a*. In this arrangement, the frame flange part 121*b* is sandwiched between the body flange part 112 and the box flange part 22, and further a packing 7 is interposed between the frame flange part 121*b* and the body flange part 112, thereby securing sealing properties. In addition, insulation material 8 is fitted on the lower surface of the frame flange part 121*b*. By the way, as clearly shown in FIG. 4, the opening 122 is curved into an arcuate shape in cross section in the front-to-back direction. Similarly, the air-fuel mixture permeable member 123 is also curved into an arcuate shape in cross section in the front-to-back direction.

In this embodiment, the air-fuel mixture permeable member 123 has formed, at a position inward of the outer peripheral edge part 123*a* of the air-fuel mixture permeable member 123, a stepped part 123*b* which is bent in a direction away from the burner frame 121 (downward). It is thus so arranged that, by this stepped part 123*b*, a clearance 124 reaching the inner peripheral edge of the burner frame 121 can be secured between the burner frame 121 and the air-fuel mixture permeable member 123. According to this arrangement, the air-fuel mixture that flows from the periphery of the opening 122 enclosed by the burner frame 121 into the clearance 124 between the burner frame 121 and the air-fuel mixture permeable member 123 penetrates (passes through) that portion of the air-fuel mixture permeable member 123 which faces this clearance 124. Therefore, by restricting the amount of the air-fuel mixture that flows into the above-mentioned clearance 124 to a smaller amount, the ejection velocity of the air-fuel mixture from that portion of the air-fuel mixture permeable member 123 which faces this clearance can be made smaller. Therefore, a flame hardly lifted can be formed in that portion of the air-fuel mixture permeable member 123 which faces the above-mentioned clearance 124, i.e., in that portion adjacent to an outward of the peripheral part of the opening 122 enclosed by the burner frame 121. Resistant property to the flame lifting can be improved.

By the way, in order to secure the clearance 124 between the burner frame 121 and the air-fuel mixture permeable member 123 even under the occurrence of thermal deformations and the like, the clearance 124 must be made larger to a certain extent. It therefore becomes difficult to restrict the amount of air-fuel mixture that flows into the clearance 124 to a smaller amount. As a solution, according to this embodiment, there is formed a bent edge part 121*c* which is formed on an inner peripheral edge of the burner frame 121, in a manner to be bent toward the air-fuel mixture permeable member 123 (downward). According to this arrangement, even if the clearance 124 is made larger, the amount of the air-fuel mixture to flow into this clearance 124 can be restricted to a small amount.

Figure 7:
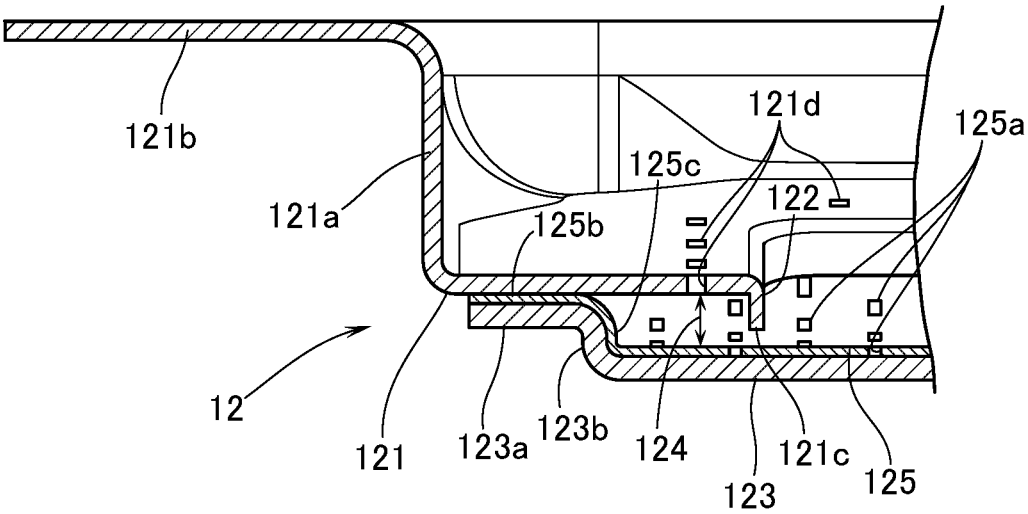
FIG. 7 is an enlarged sectional view of an essential part of the combustion plate part of the totally aerated combustion burner, corresponding to FIG. 5, according to a second embodiment.
Figure 8:
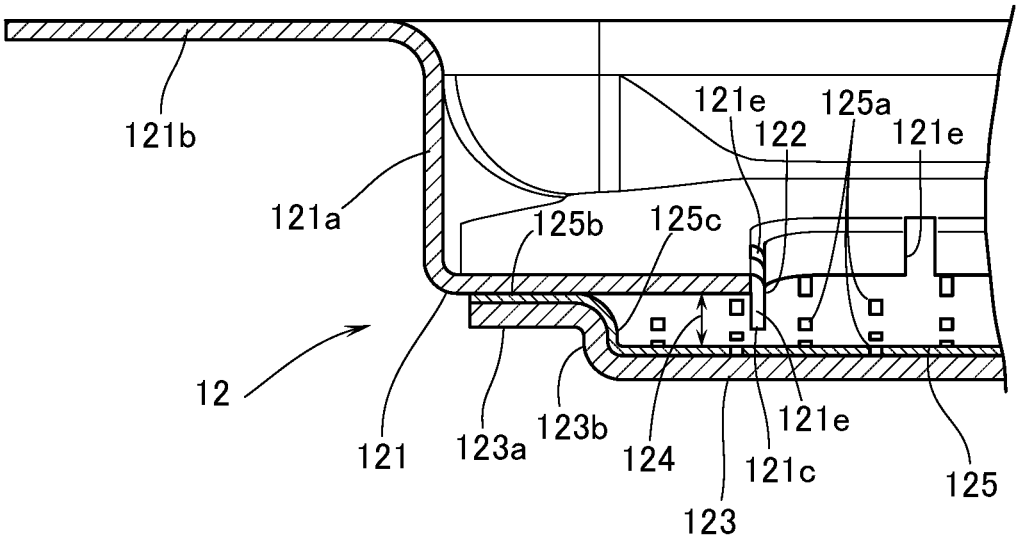
FIG. 8 is an enlarged sectional view of an essential part corresponding to FIG. 5 of the combustion plate part of a totally aerated combustion burner according to a third embodiment.

However, by simply forming the bent edge part 121*c*, there is a possibility that the bent edge part 121*c* and the air-fuel mixture permeable member 123 come too close to each other due to thermal deformation and the like, whereby the amount of the air-fuel mixture to flow into the above-mentioned clearance 124 becomes too small. As a solution, according to a second embodiment as shown in FIG. 7, preferably in that portion of the burner frame 121 which faces the above-mentioned clearance 124, a plurality of through-holes 121*d* shall be formed at a distance from one another in a circumferential direction, or according to a third embodiment as shown in FIG. 8, preferably a plurality of notches 121*e* shall preferably be formed in the bent edge portion 121*c* at a distance from one another in a circumferential direction. According to the above-mentioned arrangements, since the air-fuel mixture flows into the above-mentioned clearance 124 through these through-holes 121*d* or through the notches 121*e*, the amount of the air-fuel mixture that flows into the above-mentioned clearance 124 can be prevented from getting too small.

Further, according to these embodiments, a distribution plate 125 having formed therein a multiplicity of distribution holes 125*a* overlaps that rear surface of the air-fuel mixture permeable member 123 which faces the burner frame 121 side. Then, in a state in which the outer peripheral edge part 125*b* of the distribution plate 125 is sandwiched between the outer peripheral edge part 123*a* of the air-fuel mixture permeable member 123 and the burner frame 121, the outer peripheral edge part 123*a* of the air-fuel mixture permeable member 123 is spot-welded to the burner frame 121. In addition, the distribution plate 125 has formed therein a stepped part 125*c* which is overlapped with the stepped part 123*b* of the air-fuel mixture permeable member 123. The distribution plate 125 may be omitted.

Embodiments of this invention have been described with reference to the drawings, but this invention shall not be limited to the above. For example, in the above-mentioned embodiments, the air-fuel mixture permeable member 123 has formed therein a stepped part 123*b* that is bent in a direction away from the burner frame 121 to thereby secure the clearance 124 between the burner frame 121 and the air-fuel mixture permeable member 123. Alternatively, the following arrangement may also be conceivable, i.e., the burner frame 121 has formed therein a stepped part that is bent in a direction away from the air-fuel mixture permeable member 123. Or else, the air-fuel mixture permeable member 123 has formed therein a stepped part that is bent in a direction away from the burner frame 121, and also the burner frame 121 has formed therein a stepped part that is bent in a direction away from the air-fuel mixture permeable member 123. In this manner, the clearance 124 may be secured between the burner frame 121 and the air-fuel mixture permeable member 123. Further, the totally aerated combustion burner in the above-mentioned embodiments is arranged so that the open surface 111 of the burner body 11 faces downward, but this invention can similarly be applicable also to a totally aerated combustion burner in which the open surface 11 is disposed so as to face upward.

EXPLANATION OF MARKS

| | | | |
|---|---|---|---|
| 1 | totally aerated combustion burner | | |
| 11 | burner body | 111 | open surface |
| 12 | combustion plate part | 121 | burner frame |
| 121c | bent edge part | 121d | through-hole |
| 121e | notch | 122 | opening |
| 123 | air-fuel mixture permeable member | | |
| 123a | outer peripheral edge part | 123b | stepped part |
| 124 | clearance | 125 | distribution plate |
| 125a | distribution hole | | |

The invention claimed is:

1. A totally aerated combustion burner comprising:

a burner body which is supplied inside thereof with an air-fuel mixture; and a combustion plate part which covers an open surface of the burner body and through which the air-fuel mixture is ejected, the combustion plate part being made up of a burner frame circumferentially enclosing one single opening in a center extended through the burner frame, and an air-fuel mixture permeable member which is made of heat-resistant fibers and which covers the one single opening, from a side opposite to the burner body, wherein:

an outer peripheral edge part of the air-fuel mixture permeable member is connected to a portion of the burner frame that is disposed outward by a predetermined distance from an inner peripheral edge of the burner frame;

a stepped part is formed in at least one of the burner frame and the air-fuel mixture permeable member at a position inward of the outer peripheral edge part of the air-fuel mixture permeable member, the stepped part being bent in a direction away from the other of the burner frame and the air-fuel mixture permeable member; and a clearance reaching the inner peripheral edge of the burner frame is secured by the stepped part, between the burner frame and the air-fuel mixture permeable member.

2. The totally aerated combustion burner according to claim 1, further comprising a bent edge part formed on the inner peripheral edge of the burner frame, in a manner to be bent toward the air-fuel mixture permeable member.

3. The totally aerated combustion burner according to claim 2, wherein a portion of the burner frame which faces the clearance has formed therein a plurality of through-holes at a distance from one another in a circumferential direction.

4. The totally aerated combustion burner according to claim 2, wherein the bent edge part has formed therein a plurality of notches at a distance from one another in a circumferential direction.

5. The totally aerated combustion burner according to claim 1, wherein a distribution plate having therein a multiplicity of distribution holes overlaps a rear surface of the air-fuel mixture permeable member which faces the burner frame.

* * * * *